US010646017B2

(12) United States Patent
Moretti

(10) Patent No.: US 10,646,017 B2
(45) Date of Patent: May 12, 2020

(54) WIPER DEVICE

(71) Applicant: LUMSON S.p.A., Capergnanica (IT)

(72) Inventor: Matteo Moretti, Crema (IT)

(73) Assignee: LUMSON S.P.A., Capergnanica (CR) (IT)

( * ) Notice: Subject to any disclaimer, the term of this patent is extended or adjusted under 35 U.S.C. 154(b) by 0 days.

(21) Appl. No.: 16/183,100

(22) Filed: Nov. 7, 2018

(65) Prior Publication Data

US 2019/0133295 A1 May 9, 2019

(30) Foreign Application Priority Data

Nov. 7, 2017 (IT) ..... 102017000126722

(51) Int. Cl.

| | |
|---|---|
| ***A45D 34/00*** | (2006.01) |
| ***A45D 34/04*** | (2006.01) |
| ***A45D 40/00*** | (2006.01) |
| ***A45D 40/26*** | (2006.01) |

(52) U.S. Cl.

CPC ..... *A45D 34/00* (2013.01); *A45D 34/046* (2013.01); *A45D 40/00* (2013.01); *A45D 40/267* (2013.01)

(58) Field of Classification Search

CPC .... A45D 34/00; A45D 34/042; A45D 24/043; A45D 34/045; A45D 34/046; A45D 34/047; A45D 40/262; A45D 40/264; A45D 40/267; A45D 40/268

See application file for complete search history.

(56) References Cited

U.S. PATENT DOCUMENTS

| | | | | |
|---|---|---|---|---|
| 2002/0195117 | A1 | 12/2002 | Bailly | |
| 2003/0172950 | A1 | 9/2003 | Bouix et al. | |
| 2012/0069660 | A1* | 3/2012 | Iwai | G11C 16/0483 365/185.11 |
| 2014/0234007 | A1* | 8/2014 | Lee | A45D 34/00 401/121 |
| 2014/0290681 | A1 | 10/2014 | Pires et al. | |
| 2016/0015151 | A1* | 1/2016 | Balestrini | A45D 34/046 401/122 |

FOREIGN PATENT DOCUMENTS

EP 1452110 A1 9/2004

OTHER PUBLICATIONS

Search Report and Written Opinion dated May 4, 2018 for Italian patent application No. 102017000126722.

* cited by examiner

*Primary Examiner* — David J Walczak

(74) *Attorney, Agent, or Firm* — Vorys, Sater, Seymour and Pease LLP

(57) ABSTRACT

Wiper device for blown glass or plastic container, including a hollow body having a first and a second end defining respectively a first and a second opening, a flange extending from an outer surface of the hollow body at the first end, and a wiper element extending from an inner surface of the hollow body, the wiper element defining a passage with a smaller section than the first and second openings, the hollow body featuring at least one first row and one second row of flexible fins extending from the outer surface of the hollow body, near the second end The second row of flexible fins, which is closer to the second end in respect to the first row has, in a non-flexed configuration, a diameter greater than the diameter of the first row of fins in a non-flexed configuration.

20 Claims, 2 Drawing Sheets

WIPER DEVICE

CROSS REFERENCE TO RELATED APPLICATION

This claims the benefit of Italian patent application no. 102017000126722, filed Nov. 7, 2017, hereby incorporated by reference in its entirety.

FIELD OF THE INVENTION

The present invention relates to a wiper device.

In particular, it refers to a wiper device for dropper pipettes, mascara brushes, lip gloss brushes, or nail polish brushes, to be associated with containers made of blown glass or plastic.

BACKGROUND ART

In the cosmetics field and in the medical field, there are commonly known containers inside which there is a fluid to be dispensed. The said fluid may be an anti-wrinkle solution, a fluid for the face or body, or products for the cosmetics and make-up market, such as foundation, lip gloss, liquid lipstick, mascara, concealer, primer for eyes, and primer for lips.

These containers are equipped with a cap for sealing.

In certain applications, in order to allow the extraction and the effective and localised use of the fluid from inside the bottle, the cap is associated with a dropper, which is equipped with an elastic element at the top thereof. When the elastic element is pressed, an overpressure is created inside the dropper (and in particular inside an element thereof called a pipette), which leads to the expulsion of the product contained within the pipette.

Upon releasing the pressure on the elastic element, a vacuum is created inside the pipette which, if the pipette is immersed in the fluid, allows the suction thereof into the pipette, thus preparing the fluid for a subsequent dispensing thereof.

Since the pipette is immersed in the fluid during use, the pipette is wet externally and may drip in an undesired manner during use, thus changing the dose of the product dispensed. This is not tolerable and therefore, in the most advanced systems, what is known as a 'wiper' is associated with the bottle opening, which cleans the exterior of the pipette simultaneously upon extraction thereof from the bottle.

In other applications, a stem is applied to the cap, with a semi-rigid element (called applicator) fastened to one end thereof, to concentrate the product in a particular position and allowing the localised application thereof.

Different applicator configurations allow different areas of application, with the possibility of diversifying the texture as well.

The wipers according to prior art are very simple and usually comprise a tubular element which is fastened, by interference fit, to a mouth of the container. Internally, the tubular element provides a passageway with a smaller section, which is sized according to the external dimension of the pipette. Therefore, when the pipette is moved within the passageway with a smaller section, the liquid present externally thereto stops on the wiper element, then falling back into the container.

The wiper devices according to prior art are made of plastic. When the said devices must be coupled to a plastic container, also made of injection blow moulded plastic or injection stretch blow moulded plastic, one simply has to carefully scale the coupling tolerance so as to obtain a good seal between the wiper element and the container and a stable, long-lasting positioning of the wiper within the container.

This is due to the fact that, during production of plastic containers with the technologies described above, the dimensional tolerance which can be achieved at the mouth of the container is very good, and therefore no further modifications are necessary in order to achieve secure fastening of the wiper device.

When, however, the container where the wiper is to be applied is made of glass or plastic shaped using the conventional blow moulding technique, the matter becomes more complicated, as the dimensional tolerances achieved when blowing glass and plastic are not as good as those achieved with the techniques discussed earlier.

As a result, it is not possible to fasten a wiper element stably using conventional methods to a blown glass or plastic container. Or rather, it is not possible to stably fasten a wiper to all glass or plastic containers originating from the same production batch.

This is because, in some containers, the mouth is wider than that 'tolerated' by the wiper element, and over time the wiper element tends to slide out of the container mouth. This is not acceptable because, as is known, the containers produced by blowing are destined for a high-end market, where product quality must remain at the maximum level over time.

SUMMARY OF THE INVENTION

The object of the present invention is to provide a wiper device which may be fastened to the mouth of a container in a more stable manner than with those according to prior art.

A further object of the invention is to provide a wiper device which may also be fastened in a stable manner to blown glass or plastic containers, which are made, therefore, with less stringent tolerances than those of conventional plastic containers.

This and other objects are achieved by means of a wiper device according to the technical teachings of the claims annexed hereto.

BRIEF DESCRIPTION OF THE FIGURES

Further characteristics and advantages of the invention will become clearer in the description of a preferred but not exclusive embodiment of the device, illustrated—by way of a non-limiting example—in the drawings annexed hereto, in which.

DETAILED DESCRIPTION OF THE INVENTION

With reference to the figures stated, reference number 1 is used to denote, as a whole, a wiper device.

The wiper device 1 is configured to be inserted into a container 20 made of blown plastic or glass.

Figure 5:
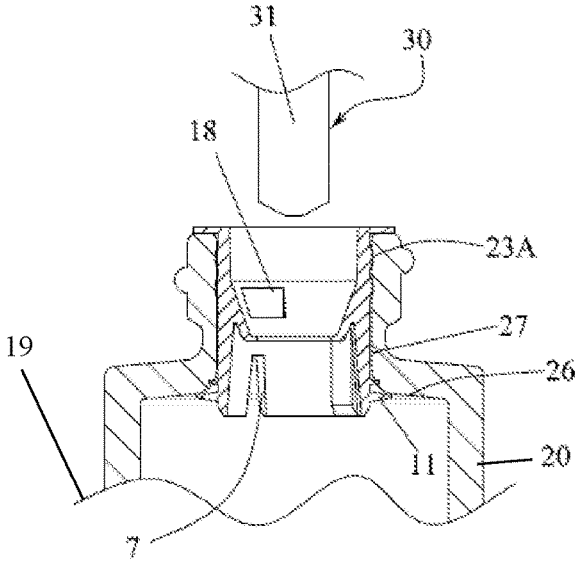
FIGS. 5 and 6 are simplified sections taken, respectively, along lines III-III and IV-IV in FIG. 2, when the wiper is inserted in the mouth of a container.
Figure 6:
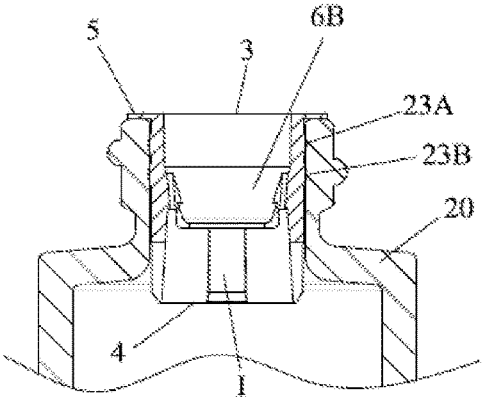

Inside the container 20, there is a fluid 19 that may be dispensed or metered out by means of a dropper 30, equipped with a pipette 31 (FIG. 5).

The wiper device 1 comprises a hollow body 2 having a first 3 and a second end 4 defining respectively a first 3A and a second opening 4A. At the first end, there is a flange present, which extends from an outer surface 2A of the hollow body 2.

Then, there is a wiper device 6 present, which extends from an inner surface 2B of the hollow body 2.

Figure 1:
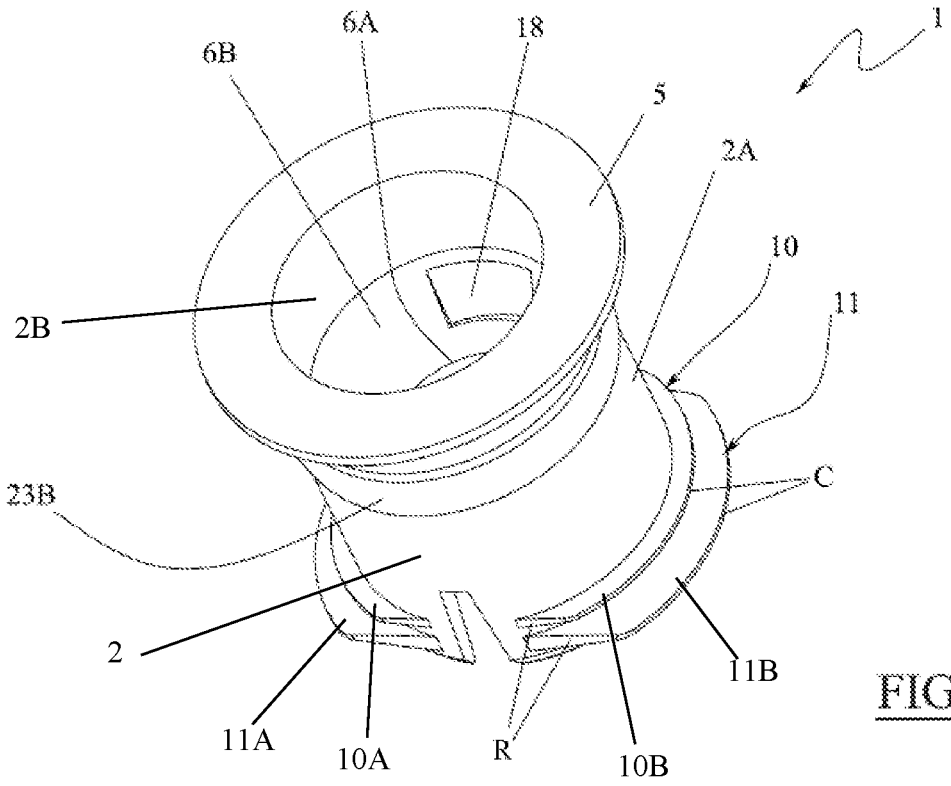
FIG. 1 is a top-down perspective view of a wiper device according to the present invention.
Figure 2:
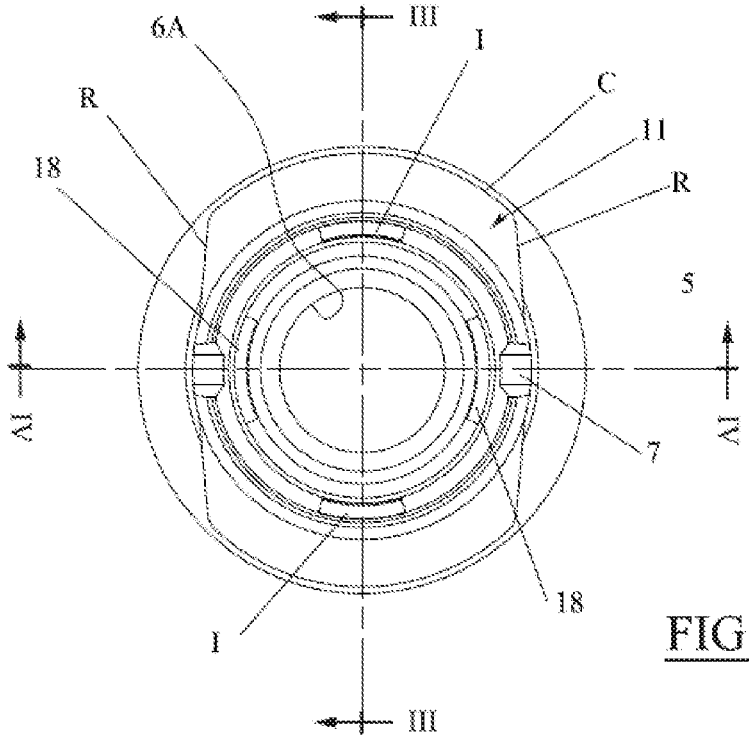
FIG. 2 is a bottom-up plan view of the wiper device in FIG. 1.
Figure 3:
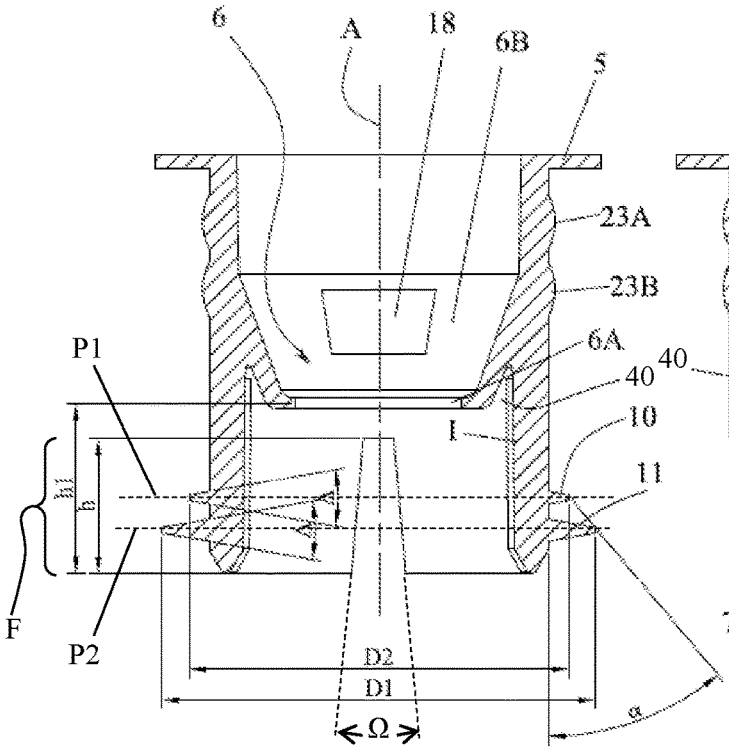
FIGS. 3 and 4 are sections taken, respectively, along lines III-III and IV-IV in FIG. 2.

As can be seen from FIGS. 1 and 3, the wiper element 6 comprises a frustoconical surface 6B converging towards the second end 4 of the hollow body; the frustoconical surface defines a passage 6A with a smaller section than that of the first and second openings 3A, 4A.

To fasten the wiper device to a neck of a blown container 20, as seen in FIGS. 3 and 5, the hollow body 2 features at least a first row 10 and a second row 11 of flexible fins extending from the outer surface 2A of the hollow body, near the second end 4.

The second row of flexible fins 11, which is that closest to the second end 4 with respect to first row 10, features—in a non-flexed configuration—a diameter D1 which is greater than the diameter D2 of the first row 10 of fins in a non-flexed configuration.

The first row of fins may comprise two first fins 10A, 10B arranged, when not flexed, on a same first plane P1, perpendicular to an axis A of the wiper device, and/or wherein the second row of fins comprises two second fins 11A, 11B, arranged, when not flexed, on a same second plane P2, which is closer to the second end 4 than the first plane P1.

Advantageously, the first and second row of fins extend from the hollow body into an area close to the second end 4, and in particular into a band (with height h1) included between the second end 4 of the hollow body and the wiper element 6.

Furthermore, each of the first fins 10A, 10B and/or each of the second fins 11A, 11B may comprise, in a plan view, a first portion C of the external perimeter forming an arc of a circle, the ends of the arc being connected to two straight sections R which are tangentially connected to the outer surface of the hollow body 2.

Advantageously, the fins of the first 10 and/or second row 11 have, in a radial section, a trapezoidal configuration (as can be seen in FIG. 3) with a base located on the outer surface of the hollow body 2. The section, in alternative forms, may also be triangular.

According to a preferred embodiment, the angle Δ (FIG. 3) between the sides of the (trapezium or triangle) may be between 10° and 30°, preferentially 20°.

Furthermore, the segment joining the free ends of the first and second rows of fins may form an inclined angle α ranging from 30° to 50° with respect to the axis of the hollow body, preferably inclined by 40°.

Said angle allows optimal fastening of the wiper device onto the neck of the container, preventing the unintentional extraction thereof.

To improve elastic deformability of the hollow body during insertion thereof into the container, the hollow body may comprise at least one open window 7A on a free edge 4B of said second end 4. Advantageously, at least two diametrically facing windows are provided.

As can be seen in FIG. 3, the window may have inclined walls, advantageously inclined by an angle Ω comprised between 5° and 15°.

In this case, both the first and the second row of fins may be at least partially positioned within a band F on the outer surface where the at least one window 7A is also positioned, said band F having a height h equal to the height of at least one window 7A.

The presence of the window in correspondence with the fins increases the elastic deformability of the hollow body, thereby improving the grip of the wiper device on the glass/plastic, as well as the ease of insertion of the wiper device into the neck of the container.

Advantageously, as can be seen in the figures, at least two diametrically facing windows 7A, 7B are present. In correspondence with the windows, the fins are absent, as can be seen in FIG. 4.

Figure 4:
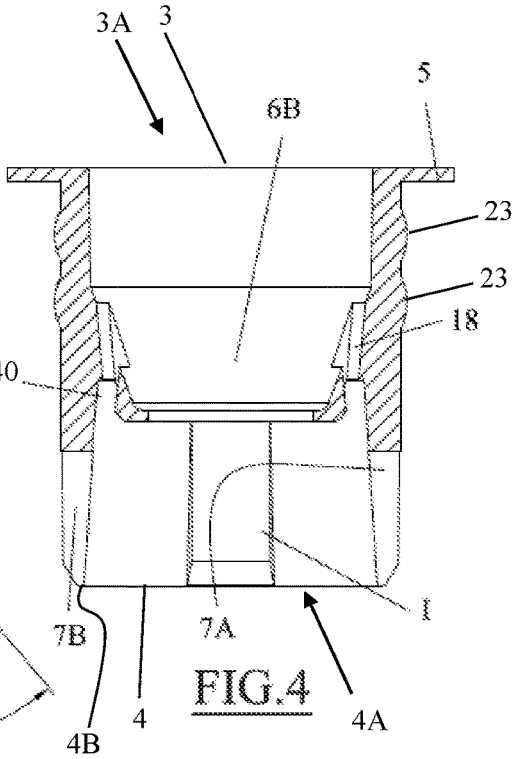

Therefore, the wiper, if viewed laterally, as in FIG. 4, has overall dimensions corresponding to that of the hollow body.

To facilitate the moulding of the wiper device, which is preferably made as a single piece of plastic material, at least one rib I, or protrusion, may be present on the inner surface of the hollow body 2, which may be positioned at a 90° angle from the window. Therefore, there are two protrusions.

Such protrusions considerably facilitate the injection moulding of the wiper device.

To complete the description, it should be noted that the wiper element 6 features at least one peripheral opening 18, preferably made in the frustoconical surface 6B of the said wiper element, which is suitable for the passage of the residues of a wiped fluid. Preferably there are two openings present, which are aligned with the windows 7 and diametrically facing.

Furthermore, as can be seen in FIG. 5, the outer surface of the wiper is configured to be inserted, in an air-tight way, into the mouth of a container. Therefore, the diameter of the outer surface of the wiper will be slightly greater and will be inserted, with an interference fit, into the mouth of the container, thus forming a seal.

Advantageously, there may be at least one perimetral protrusion or seal 23 (but in this case there are two 23A, 23B) on the external surface of the hollow body (below the flange, or better, between the flange and the passage section 6A of the wiper) preferably with a sealing ring conformation (or rather a 'semi-ring').

As already mentioned, the wiper device 1 may be made by injection moulding plastic and forming a single piece.

Some plastics suitable to produce the wiper device may include: PP-LDPE-PE-HDPE-PA-RUBBER-TPU-TPE-SILICONE.

The operation of the wiper device 1 disclosed above is clear to a person skilled in the art and is essentially as follows.

The wiper device 1 is pushed forcibly into the opening of a container made of blown glass or blown plastic, designed to contain a cosmetic or medical product.

During insertion, the fins in the two rows are flexed, making insertion quite simple.

If the windows 7A, 7B are present, deformation is easier.

When the fins reach a portion of the neck of the container which converges towards the opening of the container, the said fins expand elastically, thus securing the wiper device in position.

More specifically, said portion of the neck of the container corresponds to the connection between a shoulder 26 of the container and the neck 27.

A pipette 31 (of a dropper 30), or any other type of applicator (e.g. brush applicator) may thus be used to withdraw the fluid 19 contained within the container.

The opening 6A of the wiper is sized so as to wipe the external surface of the pipette 31, in practice cleaning the wiper of any residual fluid present on the exterior thereof.

In addition, any product residues located in the upper part of the wiper, towards the first ends of the hollow body, fall back into the container through the openings 18 described above, made in the frustoconical surface of the wiper element.

The positioning of the wiper element passage section 6A at the end of the frustoconical surface, and therefore 'separate' from the walls of the hollow body 2, safeguards the shape and size of the said wiper device, even if the hollow body 2 is subjected to pressure exerted by the neck of the container against the external surface thereof.

Regarding this, there is an annular space 40 which 'isolates' the inner wall of the hollow body from the wiper passage 6A surface, safeguarding said hollow body from any deformation and from the transmission of stresses.

To complete the description, it should be noted that the hollow body 2 may feature an external surface, which (apart from the fins, the seals 23A, 23B, and the flange 5) is similar to that of a cylinder. The diameter of the cylinder may be slightly smaller than that of the opening of the container mouth. In this case, therefore, the only parts in contact with the internal surface of the container mouth will be the seals 23A and 23B and the fins 10 and 11.

According to an alternative embodiment not illustrated, the windows 7A and 7B are absent. Therefore, the first row 10 of fins comprises a single fin extending along the entire perimeter of the hollow body 2.

Also, the second row 11 of fins comprises a single fin extending along the entire perimeter of the hollow body.

The description above discloses a wiper device comprising two rows of fins. Obviously, three or more rows of fins may also be featured. In such configurations, the fins closest to the second end will be larger in size than those further away.

And in this case, the angle formed by the segment that joins (sectionally) the free end of the various rows of fins must form an angle $\alpha$ within the range described above.

Various embodiments of the innovation have been disclosed herein, but further embodiments may also be conceived using the same innovative concept.

The invention claimed is:

1. A wiper device for a blown glass or plastic container, comprising a hollow body having a first and a second end defining respectively a first and a second opening, a flange extending from an outer surface of the hollow body at the first end, and a wiper element extending from an inner surface of the hollow body and towards the second end, the wiper element defining a passage of smaller section than the first and second openings, the hollow body providing at least one first row and a second row of flexible fins extending from the outer surface of the hollow body near the second end, the first and second rows of flexible fins being positioned distant the wiper element and being at least partially positioned in a band of the outer surface extending between the wiper element and the second end of the hollow body, and wherein the second row of flexible fins, which is closer to the second end in respect to the first row has, in a non-flexed configuration, a diameter that is greater than the diameter of the first row of fins in a non-flexed configuration.

2. The device according to claim 1, wherein either or both of the first row of fins and the second row of fins comprises a single fin extending along an entire perimeter of the hollow body.

3. The device as claimed in claim 1, wherein the first row of fins comprises two first fins arranged, when not deformed, on a same first plane perpendicular to an axis of the wiper device, and wherein the second row of fins comprises two second fins disposed, when not deformed, on a same second plane which is closer to the second end than the first plane.

4. The device as claimed in claim 3, wherein each of the first fins and each of the second fins comprises in a plan view, an outer perimeter shaped as an arc of a circle, the ends of the arc being connected to two straight sections which are tangentially connected to the outer surface of the hollow body.

5. The device as claimed in claim 1, wherein at least one first flexible fin of the first row and at least one second flexible fin of the second row each have, in a radial section, a triangular or trapezoidal configuration with a major base located on the outer surface of the hollow body.

6. The device according to claim 1, wherein the hollow body comprises at least one open window at a free edge of said second end, the at least one open window being at least partially positioned in the band of the outer surface where the first and second rows of the fins are also located, said band having a height equal to at least one window.

7. The device according to claim 6, wherein the inner surface of the hollow body has at least one rib that is angularly spaced from the window at an angle of 90°.

8. The device according to claim 1, wherein there are two diametrically-facing windows.

9. The device according to claim 1, wherein the inner surface of the hollow body has at least one rib.

10. The device according to claim 1, wherein the wiper element comprises at least one opening made on a frustoconical surface at one end of which the passage of the wiper element is defined, the opening being configured to drip residues of a wiped fluid.

11. The device according to claim 1, wherein the outer surface of the wiper is configured to form a seal within a mouth of the container, and the outer surface of the hollow body has, formed in one piece with the hollow body, at least a protruding sealing ring positioned outside said band.

12. The device according to claim 1, wherein the first row of fins comprises a single fin extending along the entire perimeter of the hollow body.

13. The device according to claim 1, wherein the second row of the fins comprises a single fin extending along the entire perimeter of the hollow body.

14. The device as claimed in claim 1, wherein the first row of fins comprises two first fins arranged, when not deformed, on a same first plane perpendicular to an axis of the wiper device.

15. The device as claimed in claim 14, wherein the second row of fins comprises two second fins disposed, when not deformed, on a same second plane which is closer to the second end than the same first plane.

16. The device as claimed in claim 1, wherein at least one flexible fin of the first row has, in a radial section, a triangular or trapezoidal configuration with a major base located on the outer surface of the hollow body.

17. The device as claimed in claim 1, wherein at least one flexible fin of the second row has, in a radial section, a triangular or trapezoidal configuration with a major base located on the outer surface of the hollow body.

18. The device as claimed in claim 1, wherein either the first row of fins comprises two first fins arranged, when not deformed, on a same first plane perpendicular to an axis of the wiper device, or the second row of fins comprises two second fins disposed, when not deformed, on a same second plane which is closer to the second end than the first plane.

19. The device as claimed in claim 18, wherein each of the first fins or each of the second fins comprises in a plan view, an outer perimeter shaped as an arc of a circle, the ends of the arc being connected to two straight sections which are tangentially connected to the outer surface of the hollow body.

20. The device according to claim 1, wherein the wiper element is configured to isolate the passage defined by the wiper element from inner surface of the hollow body.

* * * * *